US007128792B2

(12) United States Patent
Menon

(10) Patent No.: US 7,128,792 B2
(45) Date of Patent: Oct. 31, 2006

(54) STERLING SILVER MANGANESE ALLOY COMPOSITIONS

(75) Inventor: Ajit B. Menon, Lancaster, NY (US)

(73) Assignee: United Precious Metal Refining, Inc., Alden, NY (US)

( * ) Notice: Subject to any disclaimer, the term of this patent is extended or adjusted under 35 U.S.C. 154(b) by 217 days.

(21) Appl. No.: 10/807,719

(22) Filed: Mar. 24, 2004

(65) Prior Publication Data

US 2005/0211342 A1 Sep. 29, 2005

(51) Int. Cl.
*C22C 5/08* (2006.01)

(52) U.S. Cl. ..... 148/430; 420/504

(58) Field of Classification Search ..... 148/678, 148/430; 420/501–506
See application file for complete search history.

(56) References Cited

U.S. PATENT DOCUMENTS 1,970,319 A 8/1934 Kern
4,810,308 A 3/1989 Eager et al.
4,973,446 A 11/1990 Bernhard et al.
5,039,479 A 8/1991 Bernhard et al.
6,139,652 A * 10/2000 Carrano et al. ..... 148/431
6,726,877 B1 * 4/2004 Eccles ..... 420/504

FOREIGN PATENT DOCUMENTS

EP 0 752 014 B1 11/2001
WO WO 95/14112 5/1995

* cited by examiner

*Primary Examiner*—George Wyszomierski
*Assistant Examiner*—Janelle Morillo
(74) *Attorney, Agent, or Firm*—Patricia M. Costanzo

(57) ABSTRACT

A unique manganese silver alloy composition is provided, which alloy exhibits the long desired properties of exceptional as-cast hardness and reversible heat treatability, in addition to offering reduced fire scale, reduced voids and porosity, reduced grain size, and reduced oxide formation when heated consisting essentially of the following parts by weight: about 92.5–92.8% silver, about 2.0–3.0% copper, about 2.0–3.0% zinc, about 0.03–0.05% indium, about 0.01–0.03% tin, about 0.20–0.50% boron/copper alloy (22% boron, 98.0% copper) about 0.50–0.90% silicon/copper alloy (10.0% silicon, 90.0% copper), and 0.01%–0.10% manganese "30" (0.30% of a manganese-copper alloy containing about 30% manganese and about 70% copper).

1 Claim, 2 Drawing Sheets
(2 of 2 Drawing Sheet(s) Filed in Color)

Sample B, annealed condition

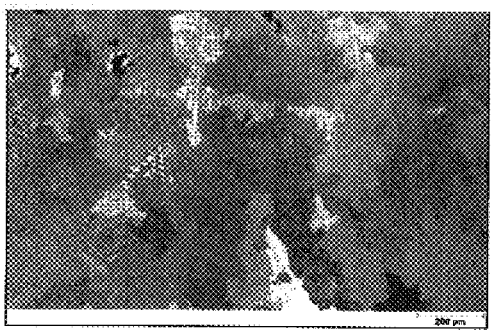
FIG. 1a Sample A, as-cast condition
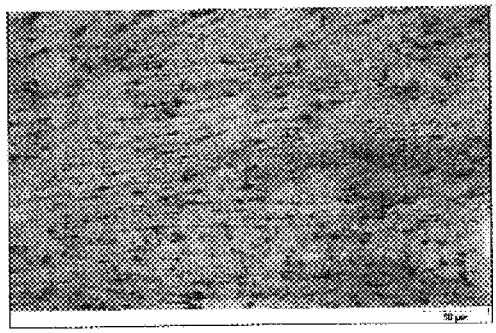
FIG. 1b Sample A, 60% cold rolled condition
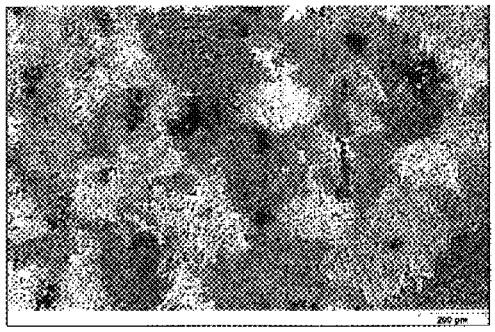
FIG. 1c Sample A, annealed condition

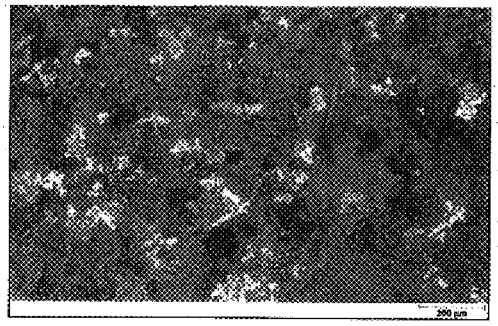
FIG. 2a Sample B, as-cast condition
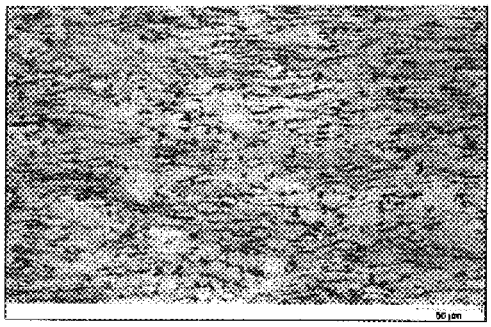
FIG. 2b Sample B, 60% cold rolled condition
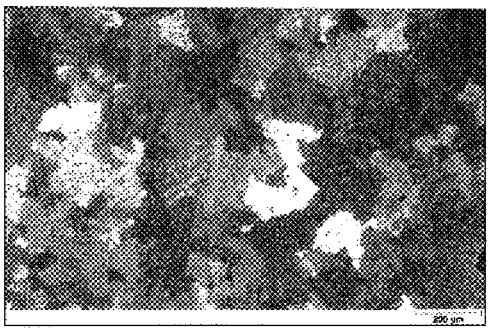
FIG. 2c Sample B, annealed condition

STERLING SILVER MANGANESE ALLOY COMPOSITIONS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

This invention relates generally to sterling silver alloy compositions of increased hardness, and more particularly is directed to sterling silver manganese alloy compositions which exhibit an exceptional and reversible hardness.

The background information discussed below is presented to better illustrate the novelty and usefulness of the present invention. This background information is not admitted prior art.

Silver metal is very ductile and malleable (being only slightly harder than gold) and is the most lustrous metal on Earth. Silver's brilliant white metallic luster can take a high degree of polish making silver highly desirable in the production of jewelry and tableware. Silver's unique properties are important in the decorative arts, coinage, industry, and photography, for example.

Silver categorized as "fine silver" comprises at least 99.5 percent pure silver. Fine silver is relatively soft having a Moh's hardness of about 2.5, a Brinell hardness of about 24.5 MN $m^{-2}$, and a Vickers hardness of about 251 MN $m^{-2}$. Thus, fine silver is generally too soft for the production of large, functional objects. Although the malleability of fine silver permits it to be easily shaped into attractive forms, products made with pure soft silver are easily dented or bent out of shape.

Fine silver has good tarnish resistance. In fact, the tarnish resistance of silver alloys increases as the percentage of fine silver increases, as pure silver is unreactive in clean air under normal conditions and unreactive with clean water. Because of it softness and malleability, however, fine silver is commonly combined with other metals to produce more durable products, thus increasing its susceptibility to tarnish.

When fine silver is combined with other metals to form a new material, the new material is referred to as an alloy. Alloyed silver cannot be classified as sterling silver unless it consists of at least 92.5 percent fine silver, whereas the remaining 7.5 percent may be a combination of other elements in various proportions. Sterling silver alloy is the material of choice where appearance is paramount and strength is important, such as in the manufacture of jewelry, coinage, and silverware. Sterling silver sets the standard for high quality silver products. In addition to offering increased strength and durability, products made with sterling silver will not wear away, as silver plating can.

The most common sterling silver alloy consists of at least 92.5 percent silver and up to 7.5 percent copper. Adding copper to silver, to produce a copper sterling silver alloy improving hardness and durability while maintaining the beautiful color of the pure silver, is a well-known practice in the art of silver manufacture. The difference between the softness of fine silver and the hardness of copper-sterling silver alloy is such that the practice is widely, if not nearly ubiquitously, used in the vast majority of sterling silver production because of the great need in the industry for material that is harder than fine silver. Despite the improvement in hardness when copper is added to fine silver to produce a copper silver alloy, there still exists a need in the industry for a harder as-cast sterling silver, particularly in the jewelry part of the industry as most of jewelry, such as earrings, rings, pendants, and the like are formed as an as-cast product. Improvement in the as-cast hardness would result in the jewelry being less susceptible to damage, such as bending, in addition to exhibiting better wear resistance and polishing ability.

While the small amount of copper that is added to fine silver produces an alloy with increased hardness and durability, the presence of copper in the alloy introduces a susceptibility to tarnishing. Copper tarnishes much more readily than does silver as copper, unlike silver, has a great affinity for oxygen. When copper reacts with oxygen, it typically forms a copper oxide that may consist of cupric or cuprous oxide, or both. When copper oxide forms on the copper that is alloyed with sterling silver, it is known as "fire scale." Fire scale is typically a darkened portion of the sterling silver piece that may result from melting or brazing, and, in fact, each time the alloy is heated, such as when the alloy is initially formed as shot, when the shot is melted and recast to form the desired article, and subsequently when the cast article is annealed. Fire scale, as compared to silver tarnish, is not limited to the surface of the sterling silver object, but may penetrate the article to some depth and, thus, may not be removable by buffing and polishing. Additionally, unless air is excluded during the casting process, the cast article may contain internal voids which, of course, can lead to undesirable porosities and grain sizes in the cast article.

There have been some attempts at alleviating some of the aforementioned problems associated with conventional sterling silver alloys. Early attempts to provide silver alloys having tarnish resisting properties and improved workability were concerned with either silver alloys that did not contain enough silver to qualify as sterling silver or with fine silver alloys, i.e., nearly pure silver. Silver alloys containing less than 92.5 percent pure silver are not of interest to the jewelry making industry because this silver cannot be labeled as sterling. Conversely, fine silver is not of interest to the jewelry making industry because it is too soft and too expensive.

Attempts at providing for sterling silver alloys and master alloys having certain desired properties, such as reduced fire scale production, reduced porosity, and reduced grain size over conventional sterling silver alloys have met with some success. Not surprisingly, these sterling silver alloys have been widely used by the industry especially for the production of silver jewelry. Despite these improvements, however, sterling silver alloys are still relatively soft and cannot provide the desired degree of as-cast hardness and the desired reversible heat treatability performance that is required by many industries that rely on the use of silver, such as the jewelry making industry.

Thus, it is appreciated that there is still an unmet need for a sterling silver alloy that possesses an increased as-cast hardness, in addition to being reversibly heat treatable, yet maintaining a substantially reduced formation of fire scale upon heating, a decrease in voids and porosity, and a reduced grain size relative to traditional sterling silver alloys.

SUMMARY

Accordingly, the present invention provides for a unique manganese sterling silver alloy composition that exhibits an exceptional as-cast hardness of 53 on the Vickers Scale of hardness (HV5%) in addition to being reversibly heat treatability, while maintaining the properties of a reduced tendency to form fire scale when heated, reduced voids and porosity, and reduced grain size. Moreover, the manganese sterling silver alloy composition of this invention, by virtue of its reduced propensity to form fire scale, reduces the number of rejected parts when such alloy is subsequently recast.

The present invention produces all of these benefits and improvements by providing for a manganese sterling silver alloy comprising the following parts by weight: about 92.5–92.8% silver, about 2.0–3.0% copper, about 2.0–3.0% zinc, about 0.03–0.05% indium, about 0.01–0.03% tin, about 0.20–0.50% boron/copper alloy (22.0% boron, 98.0% copper) about 0.50–0.90% silicon/copper alloy (10.0% silicon, 90.0% copper), and 0.01%–0.10% manganese.

As is well known in the art, the percentage of silver may be varied depending upon the desired quality and/or desired properties of the alloy to be produced. The above range encompasses sterling silver (i.e., containing at least 92.5% silver). Additionally, the proportions of the alloy components may be varied relative to each other and to the silver content depending upon the desired quality and/or desired properties of the alloy to be produced, keeping in mind that the maximum percent of non-silver elements cannot exceed 7.5 percent if the final composition is to maintain a sterling silver classification.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

In order that these and other objects, features, and advantages of the present invention may be more fully comprehended and appreciated, the invention will now be described, by way of example, with reference to a specific preferred embodiment and a comparison sample. The microstructure of the specific preferred embodiment and of the comparison sample is illustrated in appended micrograph images. It should be understood that these images depict only one preferred embodiment of the present invention and are not therefore to be considered limiting in scope. The invention will now be described and explained with added specificity and detail through the use of the accompanying photomicrographs, in which:

FIG. 1*a* is an image of Sample A, the manganese sterling silver alloy in an as-cast condition.

FIG. 1*b* is an image of Sample A, as shown in FIG. 1*a*, in a 60 percent cold rolled condition.

FIG. 1*c* is an image of Sample A, as shown in FIGS. 1*a* and 1*b*, in an annealed condition.

FIG. 2*a* is an image of Sample B, the manganese sterling silver alloy in an as-cast condition.

FIG. 2*b* is an image of Sample B, as shown in FIG. 2*a*, in a 60 percent cold rolled condition.

FIG. 2*c* is an image of Sample B, as shown in FIGS. 2*a* and 2*b*, in an annealed condition.

DEFINITIONS

"As-cast" as used herein refers to the state of an alloy after it has been melted, poured into an investment mold to make a cast piece, and cooled.

"Cold rolled" as used herein is defined as the state of an alloy after an ingot has been mechanically worked by passing it between two rolls to achieve reduction in the ingots thickness.

"Ingot" is an alloy that has been cast into a desired shape, such as a plate, for example.

DETAILED DESCRIPTION

It should be noted that the disclosed invention is disposed to embodiments in various compositions. Therefore, the embodiments described herein are provided with the understanding that the present disclosure is intended as illustrative and is not intended to limit the invention to the embodiment described herein.

The present invention is a novel, manganese sterling silver alloy composition that exhibits exceptional as-cast hardness in addition to being reversibly heat treatable, while maintaining a reduced tendency to form fire scale when heated, reduced voids and porosity, and reduced grain size as compared to conventional sterling silver alloys.

The manganese sterling silver alloys, made according to the principles of this invention, are ideally suited for use as jewelry sterling silver, because when prepared as taught herein, the alloys exhibit exceptional and reversible work hardening properties, in addition to being free from normal fire scale and having the added advantages of greatly-reduced porosity, reduced number of voids, and a reduced grain size.

The manganese sterling silver alloys, made according to the teachings presented herein, contain a proportion of silver that meets sterling silver requirements, i.e., about 92.5–92.8% silver. Manganese is added in proportions of from about 0.01%–0.10% manganese. The manganese content of the alloy has unexpectedly resulted in alloys having hardness and work hardening characteristics similar to those exhibited by conventional sterling silver alloys and improved with respect to the known fire scale resistant alloys. The improved hardness and work hardening characteristics of one preferred manganese sterling silver alloy composition (Sample A) are shown in Table 1 where Vickers Hardness (HV5%) values are given for the Sample A. For comparison, the hardness and work hardening characteristics of a known fire scale resistant alloy (Sample B) are also shown in Table 1. The copper content of the manganese alloy is from about 2.0 to about 3.0% copper and may be selected relative to the hardness requirements of the article to be cast. In addition to acting as the main carrying agent for the other alloying materials, copper is added as a conventional hardening agent. Zinc, present in amounts of about 2.0 to 3.0%, is added to reduce the melting point of the alloy, to add whiteness, to act as a copper substitute, as a deoxidant, and to improve the fluidity of the alloy. About 0.03–0.05% indium is added as a grain refining agent, and to improve the wetability of the alloy. Tin, in amounts of from about 0.01–0.03% tin, is added to provide tarnish resistance, and for its hardening effect. The boron content is from about 0.20–0.50% as a boron/copper alloy (22.0% boron, 98.0% copper) and is added to reduce the surface tension of the molten alloy, and to allow it to blend homogeneously. Silicon acts as a deoxidant, which reduces the porosity of the recast alloy, and has a slight hardening effect, and is present in an amount of from about 0.50–0.90% of a silicon/copper alloy (10.0% silicon, 90.0% copper).

The preferred embodiments of the present invention, made as described using manganese as one of the alloying materials, exhibit the particularly useful advantage of exhibiting exceptional hardness as cast compared to known sterling silver compositions. Sterling silver alloys made according to the present invention also provide a major advantage in that the exceptional hardness of the alloys is reversible. Moreover, the silver alloys described herein are resistant to deformation. This attribute is especially useful in the making of jewelry because jewelry made using the sterling silver alloys as taught herein will demonstrate a greater resistance to scratches and dents which permits the jewelry to maintain its attractiveness thereby increasing the value of the jewelry to its owners.

EXAMPLE 1

Sample A, a preferred embodiment of the manganese sterling silver alloy of the present invention, contains 92.70% silver, 2.19% copper, 0.30% manganese "30" (0.30% of a Manganese-copper alloy containing about 30% manganese and about 70% copper), 2.90% zinc, 0.05% indium, 0.24% tin, 0.59% of a boron-copper alloy containing about 2% boron and about 98% copper, and about 0.96% of a silicon-copper alloy containing about 10% silicon and about 90% copper.

Making the sterling silver alloys followed procedures conventionally known in the art. Initially, fine silver was weighed and placed in a crucible along with preferred quantities of zinc, boron-copper alloy, tin, indium and copper-manganese. The melting was done under a protective cover of a reducing gas to prevent unnecessary oxidation of metals. When the mixture was molten, copper-silicon was added to the melt to de-oxidize the melt. The molten metal was thoroughly stirred and cleaned using boric acid flux. Once the required melting temperature (2150° F.) was reached, it was poured through a tundish into water, which solidified and shaped the granules in the form of shot. Quantities of such shot were then provided to casters for testing. The shot was measured, re-melted and poured into investment castings to produce desired jewelry articles. The recast article was shown to posses an exceptional hardness, to be substantially free of fire scale, to have considerably reduced porosity, and to have a finer grain structure than conventional sterling silver alloys, and importantly, to be reversibly heat treatable. Labor time in finishing the cast article was reduced due to the elimination of the step previously needed to remove fire scale, and additionally, the rejection rate of the recast articles was substantially reduced over conventional silver-copper alloy compositions.

Sample B represents a known reduced fire scale resistant sterling silver alloy consisting essentially of the following parts by weight: about 92.5% silver, about 0.5% copper, about 4.25% zinc, about 0.02% indium, about 0.48% tin, about 1.25% of a boron-copper alloy containing about 2% boron and about 98% copper, and about 1% of a silicon-copper alloy containing about 10% silicon and about 90% copper. Except for the omission of manganese, Sample B was made following the method of making Sample A.

The values in Table 1 show that Sample A, the manganese sterling silver alloy, exhibits an increase in the Vickers Hardness (VH) scale of seven units compared to the Sample B (the reduced fire scale resistant sterling silver alloy made without the use of manganese). The observed increase in hardness is exceptional. The hardness exhibited by Sample A means that alloys made with manganese as taught herein provide for sterling jewelry that is stronger, exhibit better wear resistance, and exhibit better polishing properties.

Moreover, the values in Table 1 show that Sample A (the manganese sterling silver alloy) exhibits an exceptional increase in as-cast hardness, in addition to having the very valuable property of being reversibly heat treatable. As is well-appreciated by those in the art, the ability of a cast article to recapture its as-cast hardness after being softened by heat treatment is of extreme importance for jewelry "findings manufactures" where heat treatment is often required to soften a wire or a sheet to increase its workability; that is, in order to form the as-cast article into a desired shape easily and without cracking or stressing the material, such as when wire is drawn into a spring, during sheet making, or in the formation of intricate pieces of jewelry before annealing, the formed piece back to its original, or a desired hardness.

TABLE 1

| | Microhardness[a] | | |
|---|---|---|---|
| Sample | As-cast $HV_{500}$[a] | 60% Cold Rolled $HV_{500}$ | Annealed $HV_{500}$ |
| A Manganese Sterling Silver Alloy | 53 | 148 | 52 |
| B Known fire scale resistant sterling silver alloy, no manganese | 46 | 152 | 52 |

[a]Method in accordance with ASTM 384-99$^{EL}$.
[b]Average of three $HV_{500}$[a] readings.

EXAMPLE 2

In addition to Sample A, as described above, another preferred embodiment of the manganese sterling silver alloy of the present invention, contains 92.60% silver, 2.63% copper, 0.30% manganese "30" (which is a Manganese-copper alloy containing about 30% manganese and about 70% copper), 2.25% zinc, 0.07% indium, 0.08% tin, 0.15% of a boron-copper alloy containing about 2% boron and about 98% copper, about 1.80% of a silicon-copper alloy containing about 10% silicon and about 90% copper, and about 0.12% germanium. The exceptional hardness and the sensitivity to reversible heat treatment exhibited by Sample A, as discussed above, are also properties of Example 2.

Referring now to the figures in which micrograph images of Sample A and Sample B are shown. Images were taken of the samples in an in-cast condition, after a 60 percent cold-rolling treatment, and after an annealing treatment. Each of the treated samples was prepared for micrograph imaging as follows; a cross-section from each sample was mounted, polished, etched, and then examined and photographed under a light microscope. The 60% cold rolling is a cold work reduction that is not typical of the cold rolling technique used in the manufacture of articles, such as jewelry. It is, however, the standard practice that is used to study hardness reversibility after heat treatment, microstructure, hardness, and the like of metallurgical samples. Micrographs of Sample A are shown in: FIG. 1*a*, in an as-cast condition; in FIG. 1*b*, in a 60% cold rolled; and in FIG. 1*c*, in annealed conditions. Sample B is like-wise shown in FIG.

2*a*, in an as-cast, in FIG. 2*b*, in a 60% cold rolled, and in FIG. 2*c*, in an annealed condition.

As can be seen in the figures, each of the samples exhibits a dendritic-like structure. And, although grain size could not be determined according to ASTM E 112, images were taken using polarized light with differential contrast to distinguish dendrite size. FIGS. 1*a* and 2*a* (both showing micrograph images of the samples in an as-cast condition) clearly exhibit the grains present in each of the samples. The grains seen in FIG. 1*a* (Sample A—the manganese sterling silver alloy) are of reduced grain size compared to the grains seen in FIG. 2*a* (the known reduced fire scale resistant sterling silver alloy containing no manganese). FIG. 1*b* (Sample A) and FIG. 2*b* (Sample B) indicate the relative linearity of the grains in the two samples after they have been treated to 60% cold rolling. The grains of Sample A, after 60% cold rolling, appear to be more linear that the grains of Sample B, after 60% cold rolling. FIGS. 1*c* and 2*c* (both showing micrograph images of the samples after annealing) clearly show how the annealing results in each of the samples regaining much of its as-cast defined granular structure.

Thus it has been shown that the invention comprises a novel, manganese sterling silver alloy composition that exhibits exceptional as-cast hardness in addition to being reversibly heat treatable. Moreover the principles of the invention provide for the unexpected increase in as-cast hardness, in addition to providing for the valued property of reversible heat treatment, by the addition of manganese as a component of a sterling silver alloy formulation. Manganese is a low-cost element, which means that the exceptional as-cast hardness and reversible heat treatability that is exhibited by castings made using the manganese sterling silver alloy of the present invention is accomplished without appreciably adding to the cost of the product.

The foregoing description, for purposes of explanation, uses specific and defined nomenclature to provide a thorough understanding of the invention. However, it will be apparent to one skilled in the art that the specific details are not required in order to practice the invention. Thus, the foregoing descriptions of specific embodiments are presented for purposes of illustration and description. They are not intended to be exhaustive or to limit the invention to the precise forms disclosed. Those skilled in the art will recognize that many changes may be made to the composition and the materials used in making the composition, other embodiments, and methods of making the embodiments of the invention described herein without departing from the spirit and scope of the invention. Furthermore, the present invention is not limited to the described methods, embodiments, features or combinations of features but includes all the variation, methods, modifications, and combinations of features within the scope of the appended claims. The invention is limited only by the claims.

What is claimed is:

1. A manganese sterling silver alloy composition exhibiting the desired properties of improved hardness and reversible heat treatability, in addition to reduced fire scale formation, reduced porosity, and reduced grain size, consisting essentially of the following parts by weight: about 92.5–92.8% silver, about 2.0–3.0% copper, about 2.0 –3.0% zinc, about 0.03–0.05% indium, about 0.01–0.03% tin, about 0.20–0.50% boron/copper alloy (2.0% boron, 98.0% copper) about 0.50–0.90% silicon/copper alloy (10.0% silicon, 90.0% copper), and 0.01%–0.10% manganese.

* * * * *